US006658679B1

(12) United States Patent
Weibert

(10) Patent No.: US 6,658,679 B1
(45) Date of Patent: Dec. 9, 2003

(54) SLEEP GUARD

(76) Inventor: Henry Weibert, 12531 Del Rey Dr., Santa Ana, CA (US) 92705

( * ) Notice: Subject to any disclaimer, the term of this patent is extended or adjusted under 35 U.S.C. 154(b) by 0 days.

(21) Appl. No.: 10/222,136

(22) Filed: Aug. 16, 2002

(51) Int. Cl.[7] ..... A47G 5/00
(52) U.S. Cl. ..... 5/513; 5/658
(58) Field of Search ..... 5/513, 658, 424, 5/427, 925, 644, 654, 655.3, 655

(56) References Cited

U.S. PATENT DOCUMENTS

| | | | | | |
|---|---|---|---|---|---|
| 367,186 | A | * | 7/1887 | Caswell | 5/513 |
| 883,884 | A | * | 4/1908 | Hopkins | 5/513 |
| 1,432,383 | A | * | 10/1922 | Comings | 5/513 |
| 1,669,573 | A | * | 5/1928 | Pejka | 5/513 |
| 1,979,520 | A | * | 11/1934 | Abrams et al. | 5/513 |
| 2,208,713 | A | * | 7/1940 | Wilhelm | 5/513 |
| 2,521,780 | A | * | 9/1950 | Dodd | 5/644 |
| 2,555,905 | A | * | 6/1951 | St. Pierre | 5/513 |
| 3,680,917 | A | * | 8/1972 | Harris | 297/452.41 |
| 4,016,919 | A | * | 4/1977 | Zmijewski | 5/513 X |
| 4,233,699 | A | * | 11/1980 | Amato | 5/513 X |
| 4,255,824 | A | * | 3/1981 | Pertchik | 5/644 X |
| 4,504,989 | A | * | 3/1985 | Maltz | 5/655.3 |
| 4,583,253 | A | * | 4/1986 | Hall | 5/94 |
| 4,639,960 | A | * | 2/1987 | Quillen et al. | 5/710 |
| 4,670,923 | A | * | 6/1987 | Gabriel et al. | 5/424 |
| 4,685,163 | A | * | 8/1987 | Quillen et al. | 5/710 |
| 4,724,558 | A | * | 2/1988 | Reiff | 5/417 |
| 4,817,636 | A | | 4/1989 | Woods | |
| 5,255,958 | A | * | 10/1993 | Frischmann | 5/513 X |
| 5,335,968 | A | * | 8/1994 | Sheridan et al. | 5/654 X |
| 5,341,530 | A | * | 8/1994 | Ward | 5/655 X |
| 5,361,433 | A | * | 11/1994 | Vanzant | 5/654 X |
| 5,476,105 | A | * | 12/1995 | Toth | 5/644 X |
| 5,490,717 | A | * | 2/1996 | Greene | 5/654 X |
| 5,497,520 | A | * | 3/1996 | Kunz et al. | 5/644 X |
| 5,528,783 | A | * | 6/1996 | Kunz et al. | 5/644 X |
| 5,560,058 | A | | 10/1996 | Smith | |
| 5,699,569 | A | * | 12/1997 | Schwarz-Zohrer | 5/655 |
| 5,727,270 | A | * | 3/1998 | Cope et al. | 5/655.3 X |
| 5,742,957 | A | * | 4/1998 | Vanzant | 5/654 X |
| 5,752,524 | A | | 5/1998 | Corcoran | |
| 5,809,597 | A | * | 9/1998 | Shaw | 5/655.3 |
| 5,810,013 | A | | 9/1998 | Belfer | |
| 5,921,241 | A | | 7/1999 | Belfer | |
| 5,926,873 | A | * | 7/1999 | Fountain | 5/424 |
| 5,966,761 | A | * | 10/1999 | Williams | 5/655.3 X |
| 5,974,607 | A | | 11/1999 | Smith | |
| 6,015,471 | A | * | 1/2000 | Rimington et al. | 5/654 X |
| 6,076,526 | A | | 6/2000 | Abdelmessih | |
| 6,113,183 | A | | 9/2000 | Koch et al. | |
| 6,135,560 | A | * | 10/2000 | Fagg | 5/644 X |
| 6,363,554 | B1 | | 4/2002 | Brown | |
| 6,427,696 | B1 | | 8/2002 | Stockhausen | |
| 6,478,380 | B2 | * | 11/2002 | Ehrlich | 5/644 X |

FOREIGN PATENT DOCUMENTS

| | | | | | |
|---|---|---|---|---|---|
| GB | 646908 | A | * | 11/1950 | 5/655.3 |

* cited by examiner

*Primary Examiner*—Robert G. Santos
(74) *Attorney, Agent, or Firm*—Michael Shippey

(57) ABSTRACT

The present invention comprises a lightweight, portable guard to separate two people sleeping in a common area. The invention serves to block a great deal of the noise attendant to snoring, and to shield to some degree the transmission of airborne spray emanating from the mouth of a sleeper, and optionally to shield light reaching the sleeper. The device is portable, inflatable with air or a similar innocuous fluid, and easily deflatable for compact storage after use.

8 Claims, 2 Drawing Sheets

SLEEP GUARD

REFERENCES CITED

U.S. Patent Documents Cited

| | | |
|---|---|---|
| U.S. Pat. No. 4,817,636 | inventor Woods | Apr. 14, 1989 |
| U.S. Pat. No. 5,560,058 | inventor Smith | Oct. 1, 1996 |
| U.S. Pat. No. 5,974,607 | inventor Smith | Nov. 2, 1999 |
| U.S. Pat. No. 6,076,526 | inventor Abdelmessih | Jun. 20, 2000 |
| U.S. Pat. No. 6,113,183 | inventor Koch, et. al. | Sep. 5, 2000 |
| U.S. Pat. No. 6,363,554 | inventor Brown | Apr. 2, 2002 |

BACKGROUND OF THE INVENTION

1. Field of the Invention

The present invention relates to a device for the amelioration of snoring, blockage of light, and transmission of germs between two people sleeping in a common area. The device is soft and malleable, thereby not presenting a barrier to sleepers (such as would be presented by a solid device). The invention thus contributes to better sleeping quality and reduced germ transmission between two people sleeping in a common area.

2. Description of Related Art

U.S. Pat. No. 5,560,058 for a 2-piece sleeping guard describes a device designed for similar service. However, this device is heavy, requires assembly, and perhaps most importantly, is a solid device. The potential of a sleeping person rolling over into this device, thus inhibiting comfort and continued sleeping, distinguishes this device from the present invention. Furthermore, a multiple component device is subject to the potential loss of a component, thus rendering the entire device useless.

Much of the prior art teaches permanently affixed dividers, or devices affixed to an individual sleeper.

BRIEF SUMMARY OF THE INVENTION

The present invention comprises a lightweight, inflatable, portable guard for use to separate two people sleeping in the same area. The device is not affixed to the bed or sleeping surface, but rather floats on top, stabilized by its base from overturning or shifting position.

The present device does not purport to stop snoring, or the transmission of disease. However, said invention does serve to block a great deal of the noise attendant to snoring, or other sources, thus giving some relief to the other sleeper. Furthermore, said invention does shield to some degree the transmission of airborne spray emanating from the mouth of a sleeper. A further benefit conferred is the blockage of light, particularly for opaque versions of the device. Yet another benefit is the feature of a small tray inherent within the device, useful for storing small bedside items.

The present device is portable, and inflatable with air or a similar innocuous gas or liquid. It is easily deflatable for compact storage after use.

BRIEF DESCRIPTION OF THE DRAWINGS

The invention will now be described, by way of example only, with references to the accompanying drawings, as follows.

DETAILED DESCRIPTION OF THE INVENTION

Figure 1:
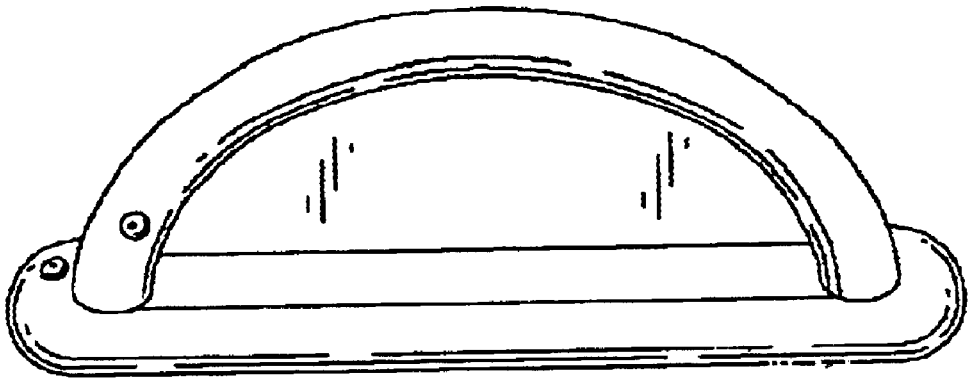
FIG. 1 depicts the invention from a side view. The shaded areas are solid. The open areas are comprised of hollow tubes. The invention is shown fully inflated.
Figure 2:
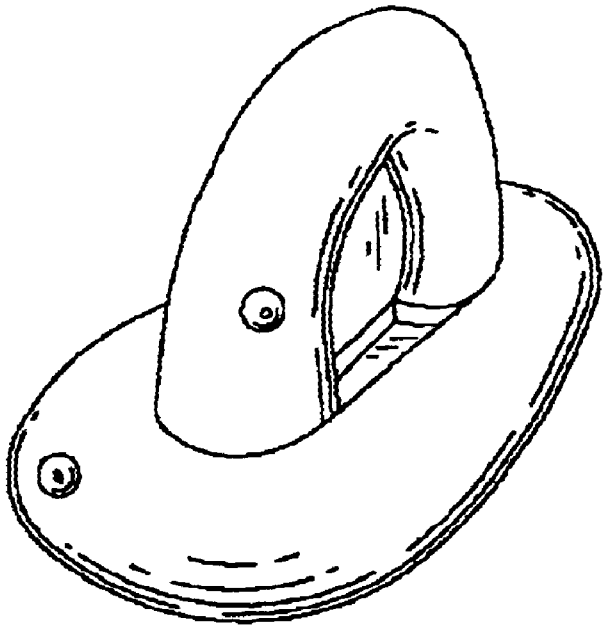
FIG. 2 depicts the invention from a ¾ frontal view. The shaded areas are solid. The open areas are comprised of hollow tubes. The invention is shown fully inflated.

The present invention is an innovative device for the amelioration of snoring, light and airborne disease vector transmission. The device is a shield, cleverly constructed of inflatable tubes to form an integral horizontal base and vertical shield. The base comprises an stretched oval tube, with long sides and short ends, as portrayed in FIG. 1. There is a long, narrow solid film filling the horizontal interior of the oval. The vertical surface is comprised of a hollow tube in the form of a semicircular arch. As in the base, the interior of the vertical arch formed by said hollow tube is filled by a solid film. The shield thus formed has no air spaces or gaps in the surface. Said solid films may be opaque or transparent.

The effect of the film and tube is that the base also forms a tray, with the solid film forming the base of the tray, and the oval tube forming a rim or lip.

While this device is primarily intended for use in and on a bed, it will be apparent to the reader that it can also be used in other common sleeping areas, including but not limited to: tent, RV, boat, futon, automobile, campsite, air mattress, and the like. It can be used outdoors on the ground, preferably on a relatively level site.

In the preferred embodiment of the invention, the device is constructed of plastic, preferable polyethylene or polyvinyl chloride, the latter widely know by the acronym PVC. The device is more preferably constructed entirely of PVC, of 0.2–1 mm thickness, more preferably about 0.4 mm in thickness. Preferably this is of a high degree of purity, such that the resulting device can be made transparent.

In the preferred embodiment, the tubes are a uniform 3 inches in diameter. The solid portion of the vertical wall is a plastic sheet in the form of a semicircle of diameter of approximately 10 inches. The vertical arch tube ends at the solid base, just inside the curve of the oval tube of said base.

Figure 3:
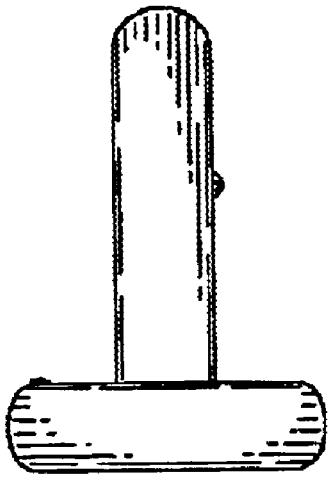
FIG. 3 depicts the invention from a end view. No solid area is visible from this view. The open areas are comprised of hollow tubes. The invention is shown fully inflated.
Figure 4:
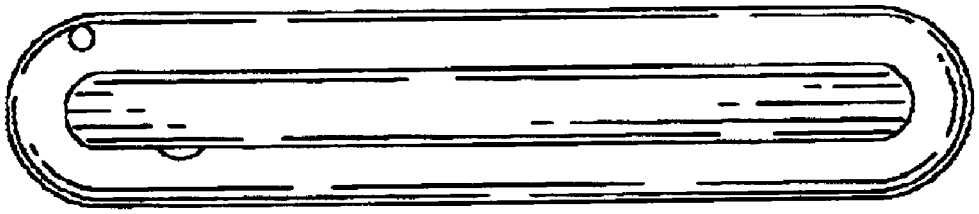
FIG. 4 depicts the invention from a full frontal view. No solid area is visible from this view. The open areas are comprised of hollow tubes. The invention is shown fully inflated.

Again in the preferred embodiment, the overall height of the shield at the apex of the arch is about 16 inches. The length of the shield along its long axis is preferably about 24 inches. When viewed on end, as displayed in FIG. 3, the shape of the shield appears as an inverted "T",with the preferred width of the short horizontal dimension about 9 inches, and the width of the longer vertical dimension about 3 inches, since the longer dimension is comprised of only 1 tube (the arch).

Preferably the invention is constructed very simply of two distinct and separate tubes, one forming the arch, and one forming the oval base, with solid film filling the interstices thus formed. Preferably the tubes are sealed from each other and the environment. Also preferably, each tube is fitted with one nozzle.

Often the user of this invention will prefer simply to fill the tubes with air. Yet this arrangement allows the user of the invention to fill the vertical arch tube with one type of fluid, and the base oval tube with another. This allows for the base to be weighted, if desired, by the filling of the base tube with a dense liquid, while filling the vertical arch with air or other gas. Preferably the fluid used to fill the device will be compatible with the material of construction of said device, in order to prevent leaks of said fluid.

In the preferred embodiment, the shield is constructed entirely of transparent plastic, as described above. This leads to another feature of the invention. If the user so desires, one or both tubes may be filled with a colored fluid, thus imparting color to the device. Since the tubes are sealed from each other, different fluids of differing colors may be used in the two tubes to produce a pleasing visual effect.

In a useful alternative embodiment, the shield is constructed entirely of opaque or colored plastic. In this embodiment, the shield is useful as a light blocker, for instance to shield the sleeper from daylight, or from light sources at night.

The preferred embodiment forms a tray in the base of the shield, between the two ends of the vertical arch. This tray is quite useful for storing handy small bedside articles, including but not limited to: remote controls, medicine bottles, baby bottles or pacifiers, and the like.

A useful feature of the present invention is its unibody construction. Unlike multi-component devices, the present invention has no pieces which are at risk of being lost or mislaid, which loss could render said multi-component devices useless.

Furthermore, the present invention is deflatable, allowing for convenient storage of the device when not in use. In a current embodiment, an actual model produced by the inventor deflates and folds to a 10 in×10 in square, of only ½ in thickness. Said thickness is limited primarily by the size of the nozzles attendant to the invention. Larger nozzles allow faster and easier filling, at the expense of larger thickness of deflated shield.

It will be apparent to the skilled reader that this description of the present invention, both in text and as shown in the accompanying drawings, should be interpreted as illustrative and not in a limiting sense to the invention herein contemplated.

I claim the following:

1. A lightweight shield or guard, comprising a vertical surface comprised of a hollow tube in the form of a substantially semicircular arch for shielding, and a horizontal base in the form of a substantially oval tube enclosing the ends of said arch for stability, further comprised of a soft material, suitable for resting on a bed or other substantially level surface between two sleeping people.

2. A shield as described in claim 1 which is further comprised of a single integral piece of construction.

3. A shield as described in claim 1 which is capable of inflation with air, or other suitable fluid, and subsequent deflation.

4. A shield as described in claim 1 which contains one or more resealable nozzles, preferably 1 in each tube, for easy inflation and deflation.

5. A shield as described in claim 1 which is further comprised of a lightweight transparent or translucent plastic such as polyethylene or polyvinyl chloride (PVC), preferably polyvinyl chloride.

6. A shield as described in claim 1 which is further comprised of an opaque inflatable material such as rubber, polyethylene or polyvinyl chloride (PVC), preferably polyvinyl chloride.

7. A shield as described in claim 1 in which the base comprises a sealed compartment with a separate nozzle, which can be filled with air, or other gas or liquid or fluid, separately from the vertical chamber.

8. A shield as described in claim 1 in which the base comprises a tray for small items, further comprising a base and a rim surrounding said base.

* * * * *